US005880440A

United States Patent [19]

Whitfield et al.

[11] Patent Number: 5,880,440

[45] Date of Patent: Mar. 9, 1999

[54] ELECTRICAL COIL INSULATOR

[75] Inventors: Charles T. Whitfield; Ronald R. Barnes; Herbert G. Ray, all of Lowndes, Miss.; T. Randall Markum, Lamar, Ala.

[73] Assignee: Emerson Electric Co., St. Louis, Mo.

[21] Appl. No.: 965,943

[22] Filed: Nov. 7, 1997

[51] Int. Cl.[6] ..... H05B 3/06

[52] U.S. Cl. ..... 219/536; 174/138 J

[58] Field of Search ..... 219/532, 536, 219/537, 542, 549; 338/286, 288, 304; 174/138, 175

[56] References Cited

U.S. PATENT DOCUMENTS

| | | | |
|---|---|---|---|
| 3,336,436 | 8/1967 | Markham . | |
| 4,268,742 | 5/1981 | Cottrell et al. . | |
| 4,363,959 | 12/1982 | Cottrell et al. . | |
| 4,458,141 | 7/1984 | Howard | 219/542 |
| 4,472,624 | 9/1984 | Janning . | |
| 4,531,017 | 7/1985 | Sherrill . | |
| 4,559,412 | 12/1985 | Howard et al. . | |
| 4,628,189 | 12/1986 | Danko | 219/532 |
| 4,675,511 | 6/1987 | Sherrill . | |
| 4,692,599 | 9/1987 | Howard et al. . | |
| 5,122,640 | 6/1992 | Holmes | 219/532 |
| 5,124,534 | 6/1992 | Williams | 219/536 |
| 5,329,098 | 7/1994 | Howard | 219/532 |
| 5,578,232 | 11/1996 | Engelke | 219/532 |

*Primary Examiner*—Teresa Walberg
*Assistant Examiner*—Jeffrey Pwu
*Attorney, Agent, or Firm*—Polster, Lieder, Woodruff & Lucchesi

[57] ABSTRACT

An electrical resistance heater (12) has an elongate electrical heating coil (C) with a plurality of convolutions (C1, C2). An electrical insulator (10) supports the convolutions and includes an insulator body (18) mountable to a support frame (19). A generally circular projection (20) extends from one side of the body and is integrally formed therewith. A generally arcuate section (26, 28) of the projection, on opposite sides of the projection, is spaced from an adjacent surface (30, 32) of the body. A notch (34, 36) is formed by the respective surfaces of the body and the projection for respective coil convolutions (C1, C2) to be received in the respective notches. The upper end (42, 44) of the faces (38, 40) of the projection are tapered outwardly from the top of the projection to facilitate coil installation. A shoulder (30*s*, 32*s*) formed on the insulator body adjacent each notch helps retain the coil convolutions in the notches. An insulator (110) having a pair of projections (120*a*, 120*b*) integrally formed with an insulator body (118) is used to support coil convolutions on both sides of the insulator.

9 Claims, 3 Drawing Sheets

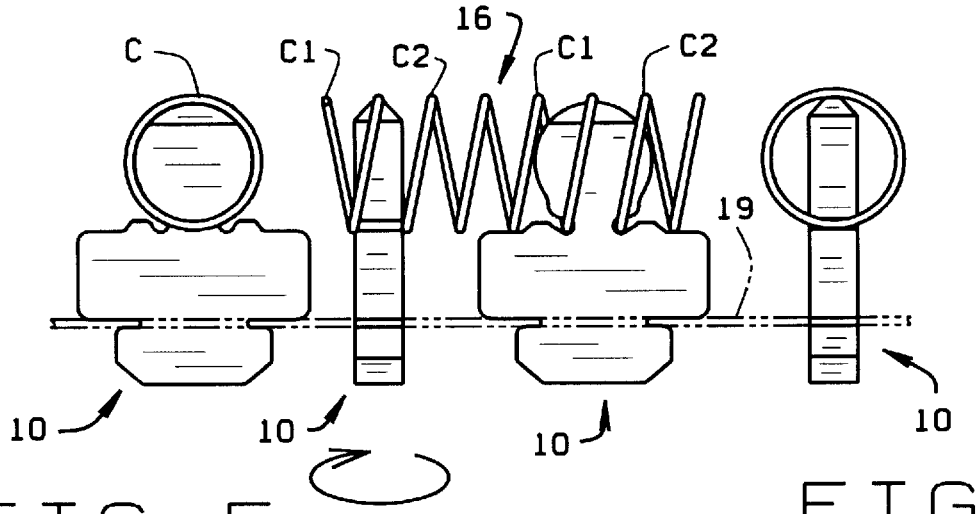
FIG. 5
FIG. 6
FIG. 7
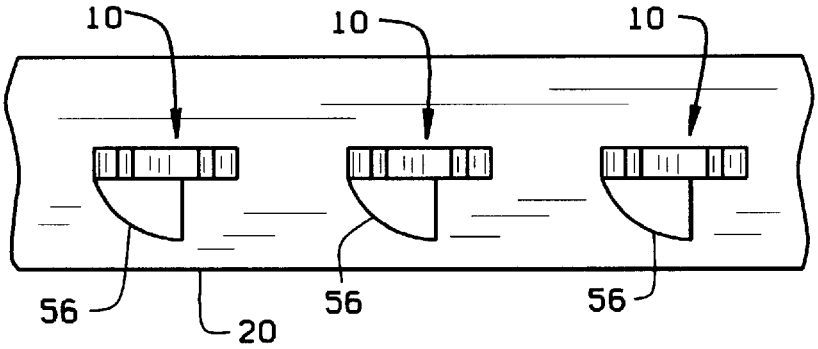
FIG. 8
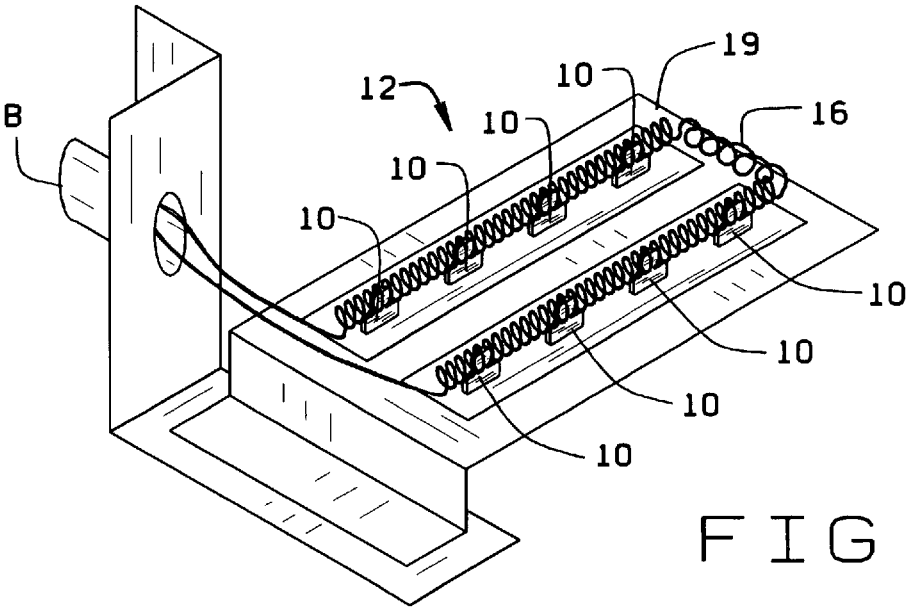
FIG. 9

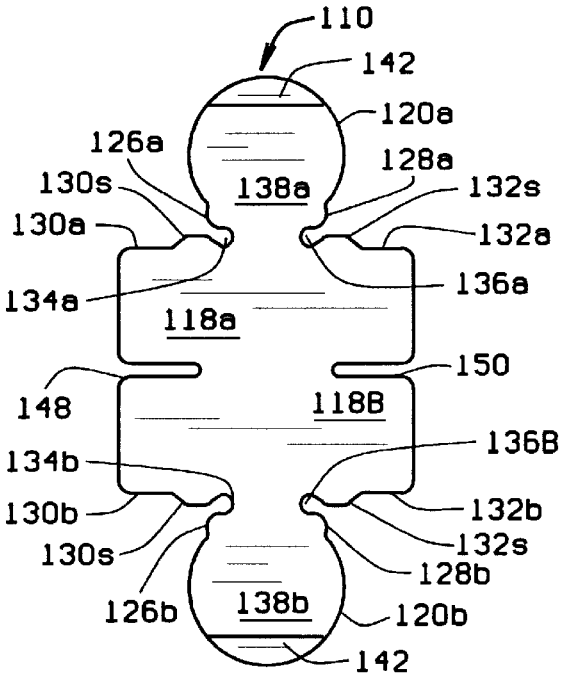
FIG. 10
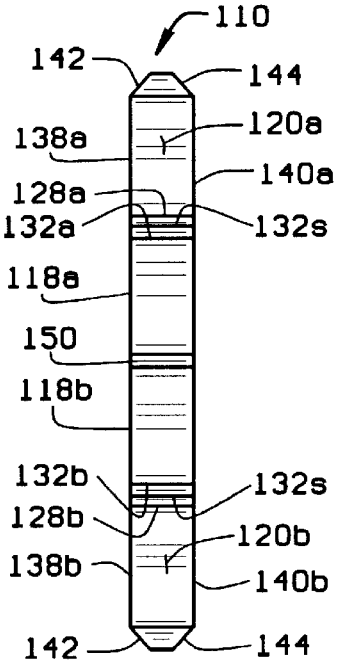
FIG. 11
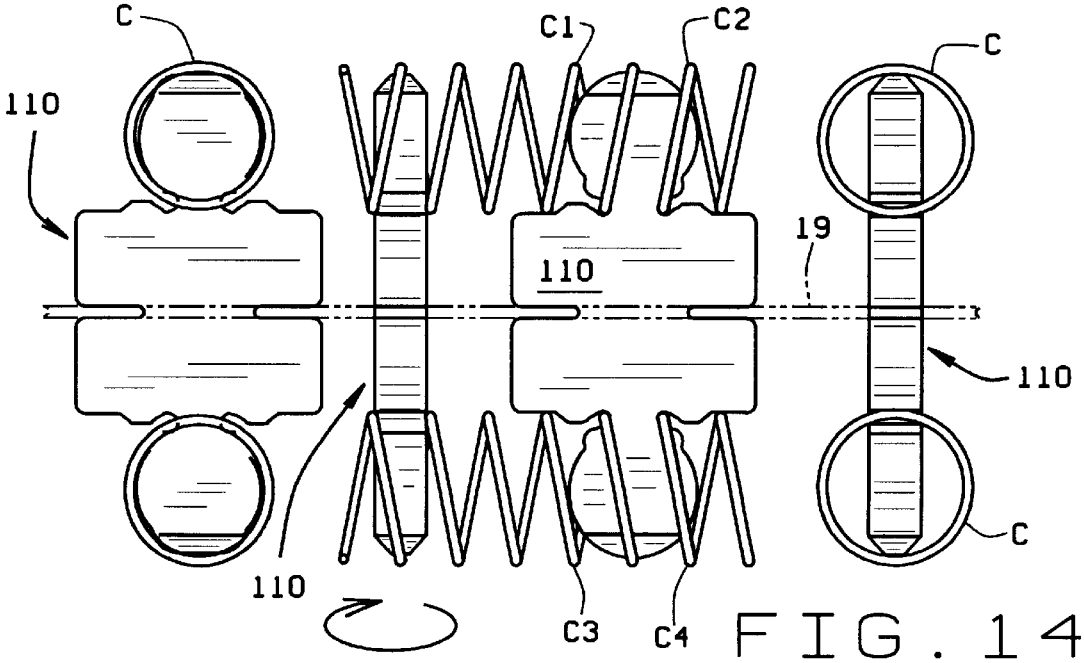
FIG. 12
FIG. 13
FIG. 14

ELECTRICAL COIL INSULATOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to electrical resistance heaters and coil insulators therefor, and more particularly, to a coil insulator for mounting adjacent convolutions of an electrical resistance heating coil, the insulator employing point suspension to mount the convolutions. The insulator has the advantages of eliminating coil bowing, and the insulator can be used in an automated assembly process for manufacturing a resistance heating assembly. Insulators for mounting convolutions for both one and two reaches of coil are described.

In heating units for use in a variety of appliances, electrical resistance heating elements are mounted on a frame and convolutions of an electrical heating coil are carried on the insulator to electrically isolate the heating element from the frame. There are a variety of insulators which have been designed for this purpose; among these being insulators such as shown and described in U.S. Pat. Nos. 4,692,599, 4,675,511, 4,559,412, 4,531,017, 4,472,624, 4,458,141, 4,363,959, 4,268,742, 4,268,189, D262,285, and D261,260. All of these insulators are designed to support a plurality of coil convolutions with some of the insulators supporting two adjacent convolutions, and some of the insulators supporting three.

Previous insulator designs have a variety of drawbacks. Some allow coil convolutions to be supported only on one side of the insulator. Others are not readily susceptible for use in automated assembly processes. Hand insertion of insulators and installation of coil convolutions onto the installed insulator is both time consuming and costly. This latter is particularly true of three point suspension insulators such as taught in the '511, '189, and '017 patents referred to above. Another problem with three point suspension insulators is that bowing of the coil can occur between insulators. This can lead to shorting of the coil. Other problems with previous insulators is their lack of ability to retain coil convolutions in place when vibrations are experienced in an appliance. Severe vibrations, or vibrations occurring over prolonged periods of time can dislodge a convolution from its associated insulator. The unrestrained convolution is now free to contact either the frame for the heating unit, or another convolution. In either instance, an electrical short results, According to the present invention, a new electrical insulator is provided which prevents dislodging of coil convolutions because of vibrations, or handling of the unit during storage, transport, or installation.

BRIEF SUMMARY OF THE INVENTION

Among the several objects of the present invention may be noted the provision of an electrical insulator securing in place convolutions of an electrical heating coil installed in a heating unit;

- the provision of such an electrical insulator to mount a plurality of adjacent coil convolutions, for example, two convolutions by point suspension;
- the provision of such an electrical insulator facilitating installation of the convolutions and holding convolutions in a spaced relationship by which the convolutions, even when the coil is heated to a high temperature, will not unduly sag and come into contact with each other, with other convolutions, or with a frame in which the heating coil is mounted, so as to prevent electrical shorts;
- the provision of such an electrical insulator having notches formed therein in which the respective coil convolutions reside, the notches being formed with a shoulder at their inlet end which prevents a convolution, once in place, from being dislodged;
- the provision of such an electrical insulator readily mounted to a frame during an automated assembly process to support the heating coil in place;
- the provision of such an electrical insulator having a main body with apertures therein for attaching the insulator to a support frame and opposed sides each of which, together with the body, form notches supporting coil convolutions, thereby for an insulator to support convolutions forming an upper reach of the heating coil and convolutions forming a lower reach thereof;
- the provision of such an electrical insulator which, when used in numbers, supports multiple runs of a heating element in such a manner as to lessen the tendency of the heating element to sag;
- the provision of such an electrical insulator which permits ready field repair;
- the provision of such an electrical insulator to contact adjacent convolutions only at localized points so to permit air circulation freely about the heating coil for efficient heat transfer;
- the provision of such an electrical insulator to be of a simple, yet rugged, construction; and,
- the provision of such an electrical insulator which is a low cost insulator that can be used as original equipment in a heating unit or as a replacement part.

In accordance with the invention, generally stated, an electrical resistance heater has an elongate electrical heating coil with a plurality of coil convolutions. An electrical insulator supporting convolutions of the coil first includes an insulator body mountable to a support frame for the insulator. A generally circular projection extends from one side of the body and has a stem formed at a base thereof by which the projection attaches to the body. The body and the projection are integrally formed. A generally arcuate section of the projection, on opposite sides of the stem, is spaced from an adjacent surface of the body. A notch is formed on opposite sides of the projection by the respective surfaces of the body and the projection for one coil convolution to be received in one notch, and for an adjacent coil convolution to be received in the other notch. The circular shape of the projection forms a surface facilitating movement of coil convolutions along the sides of the projection into the notches. A shoulder formed on the surface of the body adjacent each arcuate section of the projection, at an inlet to the respective notches helps retain the coil convolutions in the notches. Other objects and features will be in part apparent and in part pointed out hereinafter.

BRIEF DESCRIPTION OF THE SEVERAL VIEWS OF THE DRAWINGS

In the drawings,

FIGS. 5–7 illustrate use of the insulator in mounting a coil heating element for an electric heater;

FIG. 8 is a plan view of a plurality of insulators installed in a mounting frame;

FIG. 9 is a perspective view of a heating unit incorporating insulators of the present invention;

FIGS. 10 and 11 are respective front and side elevational views of a second embodiment of an insulator of the present invention; and, FIGS. 12–14 illustrate use of the insulator shown in FIGS. 10 and 11 for mounting a both and upper and a lower reach of a coil heating element for an electric heater.

Corresponding reference characters indicate corresponding parts throughout the drawings.

DETAILED DESCRIPTION OF THE INVENTION

Figure 1:
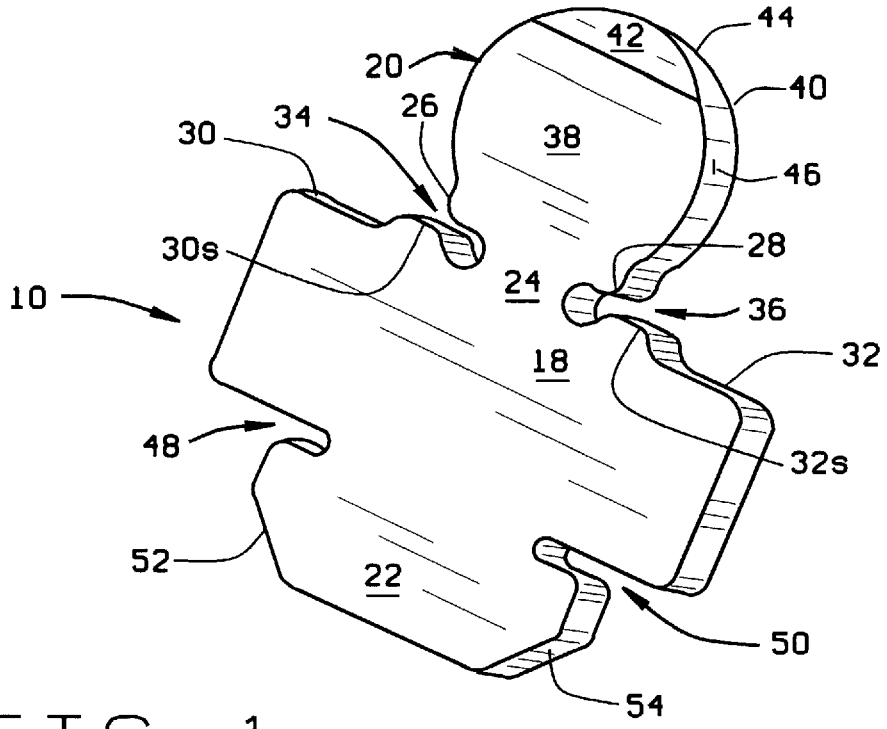
FIG. 1 is a perspective view of a first embodiment of an insulator of the present invention.
Figure 2:
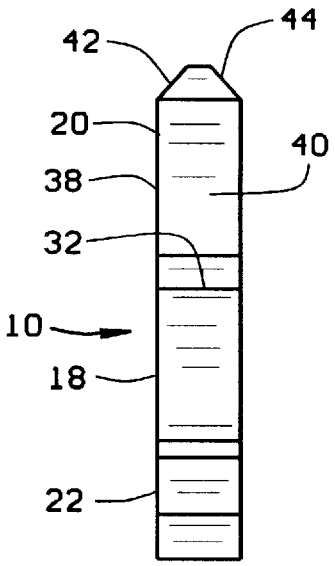
FIG. 2 is a side elevational view of the insulator.
Figure 3:
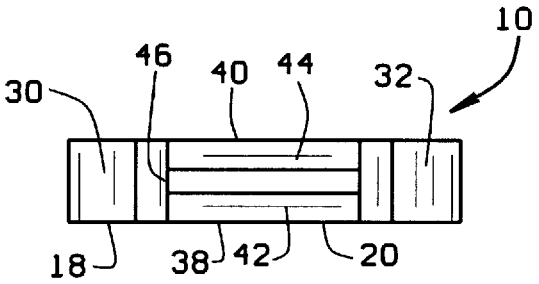
FIGS. 3 and 4 are respective top and bottom plan views of the insulator.

Referring to the drawings, an electrical insulator for use in a heating assembly is indicated generally 10. The heating assembly, which is indicated 12 in FIG. 9, comprises an electrical resistance heater having an elongate electrical heating coil 14 with a plurality of coil convolutions C. As shown in FIGS. 8 and 9, a plurality of insulators 10 are used in the heater assembly to support the heating coil. For this purpose, insulator 10 has an insulator body 18 mountable to a support frame 19 of the heating assembly. Body 18 is generally rectangular as shown in FIG. 1, and has an upper, generally circular projection 20, and a lower extension 22. The main body of the insulator, projection 20, and extension 22, are all integrally formed of a ceramic, insulative material so the insulator is of a one piece construction.

Insulator 10 is designed to support two adjacent convolutions of the electrical heating coil by point suspension. To facilitate mounting of the convolutions on the insulator, projection 20 is circular (in elevation), the diameter of the projection generally corresponding to the diameter of the heating coil with which the insulator is used. This diameter is, however, less than the width of body 18 and extension 22. The width of extension 22 is greater than the diameter of projection 20 but less than the width of body 18. A stem 24 is formed at the base of projection 20, and the projection attaches to body 18 by this stem. At the lower end of projection 20, adjacent stem 24, the sidewall of the projection flares or bulges outwardly as indicated at 26, 28 respectively. Body 18 has respective upper surfaces 30, 32 which extend outwardly toward the sides of the body. These surfaces are spaced from the flared sections of projection 20 and are directly beneath these sections. The flared sections of the projection and the corresponding upper surface of body 18 together form respective notches 34, 36 which extend inwardly. One convolution C of coil 16 is received in each of the notches. Thus, as shown in FIG. 6, a convolution C1 of the coil fits in notch 34, when the heating assembly is formed, and an adjacent convolution C2 fits in notch 36. To help retain the coil convolutions in the notches, particularly if heating assembly 12 is subject to vibrations, surfaces 30, 32 each has a raised shoulder 30*s*, 32*s* adjacent the entry into the respective notches. Each shoulder has a flat center section and curved side sections on either side of the center section. On the inward side of the shoulder, an opening is formed in which a portion of the coil convolution is seated. The shoulder and flared portion of the projection then form a restriction preventing this portion of the convolution from unseating.

Figure 4:
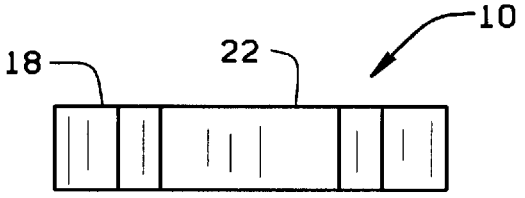

The generally circular shape of projection 20 facilitates insertion of the coil convolutions into the notches 34, 36. To also facilitate insertion, both faces 38, 40 of projection 20 have their upper ends of the projection tapered, as indicated at 42, 44, toward the top of the projection. The outer circumferential surface of projection 20 forms a rim 46. The tapered sections 42, 44 angle outwardly from this rim. When coil convolutions are inserted onto the insulator, as shown in FIGS. 4–6, the tapered portions of the faces make it easier for the convolutions to be directed into the notches 34, 36. As seen in FIG. 5, the diameter of projection 20 is approximately the same as the diameter of the coil. It will be understood therefore, that the insulator may be available in different sizes for use with different heating coils. Additionally, depending upon the coil with which insulator 10 is used, the pitch of the tapered portions of the faces may be different angles. In FIG. 6, coil mounting is accomplished by setting an insulator 10 between adjacent convolutions C1, C2 so the insulator is orthogonal to the longitudinal coil axis. The insulator is then rotated 90° as shown in the drawing. The upper ends of the convolutions are guided by the tapered upper ends of the projection, and the shoulders 30*s* and 32*s* guide the lower ends of the convolutions into the respective notches seating them in the notches.

For mounting an insulator to support frame 19, a pair of inwardly extending slots 48, 50 are formed between the main body of the insulator and lower extension 22. The height of the slots generally corresponds to the thickness of the support frame. The lower extension is narrower in width than the main body of the insulator, and the lower side sections 52, 54 of the extension taper inwardly. Support frame 19 has a plurality of spaced openings 56 which are generally semi-circular in shape. This allows the insulator to be inserted through the opening in the frame and positioned as shown on the left side of FIG. 6. Now, when the insulator is rotated to capture the coil convolutions C1, C2, the slots 48, 50 rotate onto the support to mount the insulator in place. Because of the construction of the insulator, insulators can be used in an automated assembly process by which, during manufacture of the heating assembly, insulators are positioned as shown in FIG. 6, and, by automatically rotating the insulator, coil convolutions can be mounted on the insulator simultaneously with the insulator being mounted to the support frame. It will be understood that the insulators can also be manually installed and removed for repair and maintenance purposes.

Referring again to FIG. 9, once the coil convolutions are attached to the insulators, and the insulator mounted the support frame, the support frame is installed in the heating assembly and the respective ends of the coil are attached to a terminal block B. The completed heating assembly is now completed and ready for shipment or installation in an appliance.

Referring now to FIGS. 10–14, a second embodiment of the insulator of the present invention is indicated generally 110. Insulator 110 is designed for use in heating assemblies in which there is an upper reach of coil convolutions and a lower reach as well. That is, when the insulator is mounted on support frame 19, it will support two adjacent coil convolutions C1, C2 on the one side of the support frame, and two convolutions C3, C3 on the other side of the frame; again by point suspension. Insulator 110 has two sections which are mirror images of each other. Accordingly, the insulator has body sections 118, 118*b* from which extend respective projections 120*a*, 120*b*. Projections 120*a*, 120*b* have a similar shape to projection 20 of insulator 10. As with insulator 10, each projection is integrally formed with its associated body section so to form a one-piece insulator. At the lower end of each projection 120, the sidewall of the projection flares or bulges as indicated at 126*a*, 128*a* and 126*b*, 128*b* respectively. Body sections 118*a* and 118*b* have upper surfaces 130*a*, 132*a* and 130*b*, 132*b* which extend outwardly toward the sides of the respective body sections. These surfaces are spaced from the flared sections of the projections 120*a*, 120*b* and each surface has a shoulder 130*s* and 132*s* respectively. The flared sections of the projections and the shoulders formed on the adjacent surfaces of the body sections 118*a*, 118*b* form respective notches 134*a*, 136*a*, and 134*b*, 136*b*. Again, one convolution of coil 16 is received in each of the notches.

To facilitate insertion of the convolutions into the notches, faces 138*a*, 140*a* and 138*b*, 140*b* of the respective projections have their outer ends tapered, as indicated at 142, 144 on both ends of the insulator. The tapered sections 142, 144 angle outwardly from a circumferential rim 146 of the insulator. As with insulator 10, when coil convolutions are inserted onto the insulator, the tapered portions of the faces make it easier for the convolutions to be directed into the notches. Again, the pitch angle of the tapered portion of the faces may be different depending upon the coil with which insulator 110 is used so that the insulator may be available in different sizes for use with different heating coils.

In FIGS. 12–14, coil mounting is shown as being accomplished by setting an insulator 110 between adjacent convolutions C1, C2 and C3, C4 with the insulator orthogonal to the longitudinal coil axis along both the upper and lower reaches of the coil. As with insulator 10, insulator 110 is now rotated 90° as shown in FIG. 13. The outer sections of the convolutions are guided by the tapered upper ends of the projections to help guide the convolutions into the notches where they are seated. For mounting insulator 110 to support frame 19, a pair of inwardly extending slots 148, 150 are formed between the upper and lower body sections 118*a*, 118*b* of the insulator. Again, the height of the slots generally corresponds to the thickness of support frame 19. With the openings 56 of support frame 19 semi-circular in shape, insulator 110 is inserted through the opening in the frame and positioned as shown on the left side of FIG. 13. When the insulator is rotated to capture the coil convolutions C1, C2, and C3, C4, slots 148, 150 rotate onto support frame 19 to mount the insulator in place. As with the insulator 10, insulators 110 can be used in an automated assembly process to install the insulators on the frame and secure coil convolutions in place. Also as with the insulators 10, insulators 110 are also manually installable and removable for repair and maintenance purposes.

What has been described is an electrical insulator used for mounting an electrical heating coil in place in a heating unit. A plurality of identically formed insulators are used and each insulator mounts two adjacent coil convolutions. The insulators facilitate installation of the heating coil and hold the convolutions in a spaced relationship by which, even if the convolutions sag when the coil is heated to a high temperature, the convolutions will not come into contact with each other, with other convolutions, or with the frame in which the heating coil is supported, so as to prevent electrical shorts. The insulators readily mount to the frame and have a body with apertures formed therein facilitating a twist-lock installation of the insulator. The electrical insulator has notches formed in it in which respective coil convolutions reside, and the notches have a shoulder at their inlet end to prevent a convolution from being dislodged. Each insulator has opposed sides with the notches supporting coil convolutions thus allowing the insulator to support convolutions forming upper and lower reaches of the heating coil. Design of the insulators permits free air circulation about the heating coil for efficient heat transfer.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. In an electrical resistance heater having an elongated helical electrical heating coil with a plurality of equidistantly spaced coil convolutions, an electrical insulator supporting said convolutions of said coil without deformation thereof, comprising:

a main body of electrically insulative material having a vertically-orientated rectangular configuration with oppositely disposed upper and lower edge surfaces;

an upper extension projecting from said upper edge surface of said main body, said upper extension having a substantially circular configuration corresponding to the diameter of said coil convolutions and integrally formed co-planar with said main body so as to define a stem portion, a uniform circumferential perimeter edge of said upper extension including a pair of arcuate portions adjacent said stem portion and said upper edge surface, said pair of arcuate portions, said stem portion, and said upper edge surface defining a pair of oppositely disposed side notches separated by a distance equivalent to the equidistant spacing between said coil convolutions such that when supporting said coil convolutions, a pair of adjacent convolutions seats within said side notches and circumpositioned about said perimeter edge;

each of said pair of arcuate portions adjacent said stem portion including a bulge adjacent an inlet to said side notches, said upper edge surface further including a pair of raised shoulders disposed on opposite side of said stem portion in vertical alignment with said bulges on said arcuate portions, said bulgess and said pair of raised shoulders defining constrictions adjacent said side notches such that said coil convolutions seated within said side notches are prevented from exiting said side notches; and a lower extension projecting from said lower edge surface of said main body, said lower extension having a substantially rectangular configuration integrally formed and coplanar with said main body, said lower extension including left, right, and a lower edges, said left and right edges each including outwardly projecting extensions, each of said extensions including an angled face and a shoulder portion substantially parallel to said lower edge surface of said main body, said shoulder portions and said lower edge surface defining a pair of oppositely disposed channels adjacent said left and right edges respectively, said channels adapted to facilitate installation of said insulator onto a support frame of said heater.

2. The electrical insulator of claim 1 wherein said upper extension further includes portions of a front face and a rear face, opposite said stem portion, tapered in converging alignment towards said uniform circumferential perimeter edge to facilitate rotation of said insulator about said coil to insert said coil convolutions into said side notches.

3. The electrical insulator of claim 1 wherein said lower extension has a width less than the width of said main body and said upper extension has a diameter less than the width of said lower extension.

4. The electrical insulator of claim 3 wherein said support frame comprises a plate having an opening therein sized for insertion of said lower extension, said lower extension being rotatable to rotate said electrical insulator in said opening for said channels to fit about portions of said frame adjacent said opening and retain said electrical insulator in place.

5. The electrical insulator of claim 1 wherein said upper edge surface of said main body includes portions outwardly adjacent to said raised bulges adapted to support said coil convolutions.

6. In an electrical resistance heater having an elongated helical electrical heating coil with a plurality of equidistantly spaced coil convolutions, an electrical insulator supporting said convolutions of said coil without deformation thereof, comprising:

an upper body of electrically insulative material having a vertically-orientated rectangular configuration with oppositely disposed upper and lower edge surfaces;

an upper extension projecting from said upper edge surface of said upper body, said upper extension having a substantially circular configuration corresponding to the diameter of said coil convolutions and integrally formed co-planar with said upper body so as to define a stem portion, a uniform circumferential perimeter edge of said upper extension including a pair of arcuate portions adjacent said stem portion and said upper edge surface, said pair of arcuate portions, said stem portion, and said upper edge surface defining a pair of oppositely disposed side notches separated by a distance equivalent to the equidistant spacing between said coil convolutions such that when supporting said coil convolutions, a pair of adjacent convolutions seats within said side notches and circumpositioned about said perimeter edge;

each of said pair of arcuate portions adjacent said stem portion including a bulge adjacent an inlet to said side notches, said upper edge surface further including a pair of raised shoulders disposed on opposite side of said stem portion in vertical alignment with said bulges on said arcuate portions, said bulges and said pair of raised shoulders defining constrictions adjacent said side notches such that said coil convolutions seated within said side notches are prevented from exiting said side notches;

a lower body of electrically insulative material having a vertically-orientated rectangular configuration identical to said upper body, with oppositely disposed upper and lower edge surfaces, said lower body joined to said upper body along a portion of upper body lower edge surface and said lower body upper edge surface, said unjoined portions of said upper and lower bodies defining oppositely disposed lateral channels adapted for installation of said insulator into a support frame of said resistance heater; and a lower extension projecting from said lower edge surface of said lower body, said lower extension a mirror image of said upper extension.

7. The electrical insulator of claim 6 wherein said upper extension further includes portions of a front face and a rear face, opposite said stem portion, tapered in converging alignment towards said uniform circumferential perimeter edge to facilitate rotation of said insulator about said coil to insert said coil convolutions into said side notches.

8. The electrical insulator of claim 6 wherein said upper extension has a diameter less than the width of said upper body.

9. The electrical insulator of claim 8 wherein said support frame comprises a plate having an opening therein sized for insertion of said lower body and lower extension, said lower body and lower extension being rotatable to rotate said electrical insulator in said opening for said lateral channels to fit about portions of said frame adjacent said opening and retain said electrical insulator in place.

* * * * *